United States Patent [19]

Shimer et al.

[11] 4,204,139

[45] May 20, 1980

[54] INTEGRAL FLUORESCENT LAMP-BALLAST UNIT

[75] Inventors: Robert M. Shimer, Topsfield; Joseph A. Dombrowski, Manchester; Sheppard Cohen, Danvers, all of Mass.

[73] Assignee: GTE Sylvania Incorporated, Stamford, Conn.

[21] Appl. No.: 890,278

[22] Filed: Mar. 27, 1978

[51] Int. Cl.[2] ..... H01J 25/50; H01J 13/46; H01J 19/78; H01K 1/62

[52] U.S. Cl. ..... 315/58; 315/DIG. 5; 315/DIG. 2; 315/59; 339/52 R

[58] Field of Search ..... 315/57, 58, 60, DIG. 5, 315/59, DIG. 7, DIG. 2; 339/52 R, 53

[56] References Cited

U.S. PATENT DOCUMENTS

| | | | |
|---|---|---|---|
| 2,372,295 | 3/1945 | Rubenstein et al. | 315/58 X |
| 2,597,060 | 5/1952 | Boutelle et al. | 339/52 R |
| 3,974,418 | 8/1976 | Fridrich | 315/DIG. 5 |
| 4,064,416 | 12/1977 | Krense et al. | 315/60 |
| 4,070,571 | 1/1978 | Robertson et al. | 339/52 R |
| 4,092,562 | 5/1978 | Campbell | 315/DIG. 5 |

FOREIGN PATENT DOCUMENTS

| | | | |
|---|---|---|---|
| 2331935 | 1/1975 | Fed. Rep. of Germany | 315/58 |
| 7205602 | 4/1972 | Netherlands | 315/58 |

*Primary Examiner*—Saxfield Chatmon, Jr.
*Attorney, Agent, or Firm*—James Theodosopoulos

[57] ABSTRACT

An integral fluorescent lamp-ballast unit comprises a fluorescent lamp fastened to an end cap at one end and a housing at the other end. An elongated support member extends between the end cap and the housing, is fastened to both, and serves as a backing for the lamp. The ballast comprises a choke and a preheat starter which are disposed in the end cap and/or housing.

6 Claims, 3 Drawing Figures

INTEGRAL FLUORESCENT LAMP-BALLAST UNIT

THE INVENTION

This invention relates to a fluorescent lamp and ballast that together comprise an integral unit. Such a unit can be readily installed by a homeowner and can be simply plugged into a residential electrical outlet.

The advantage of the integral fluorescent lamp-ballast unit of this invention is that it is more efficient than similar units presently commercially available, as exemplified by U.S. Pat. No. 3,996,493, and is thus energy saving.

An integral fluorescent lamp-ballast unit in accordance with this invention comprises a tubular fluorescent lamp fastened to a housing at one end and to an end cap at the other. An elongated support member connects the housing with the end cap, and provides a backing for the lamp. Disposed within the housing is a choke ballast which may have a normally closed circuit breaker secured thereto. A preheat lamp starter is disposed in the end cap. The preheat lamp starter may be a simple manual switch that is closed for one or two seconds and is then released to open, or it may be an automatic starter, such as a thermal-switch, glow-switch starter and the like. The overall lamp-ballast unit is only slightly longer than the lamp.

Figures 1, 2, 3:
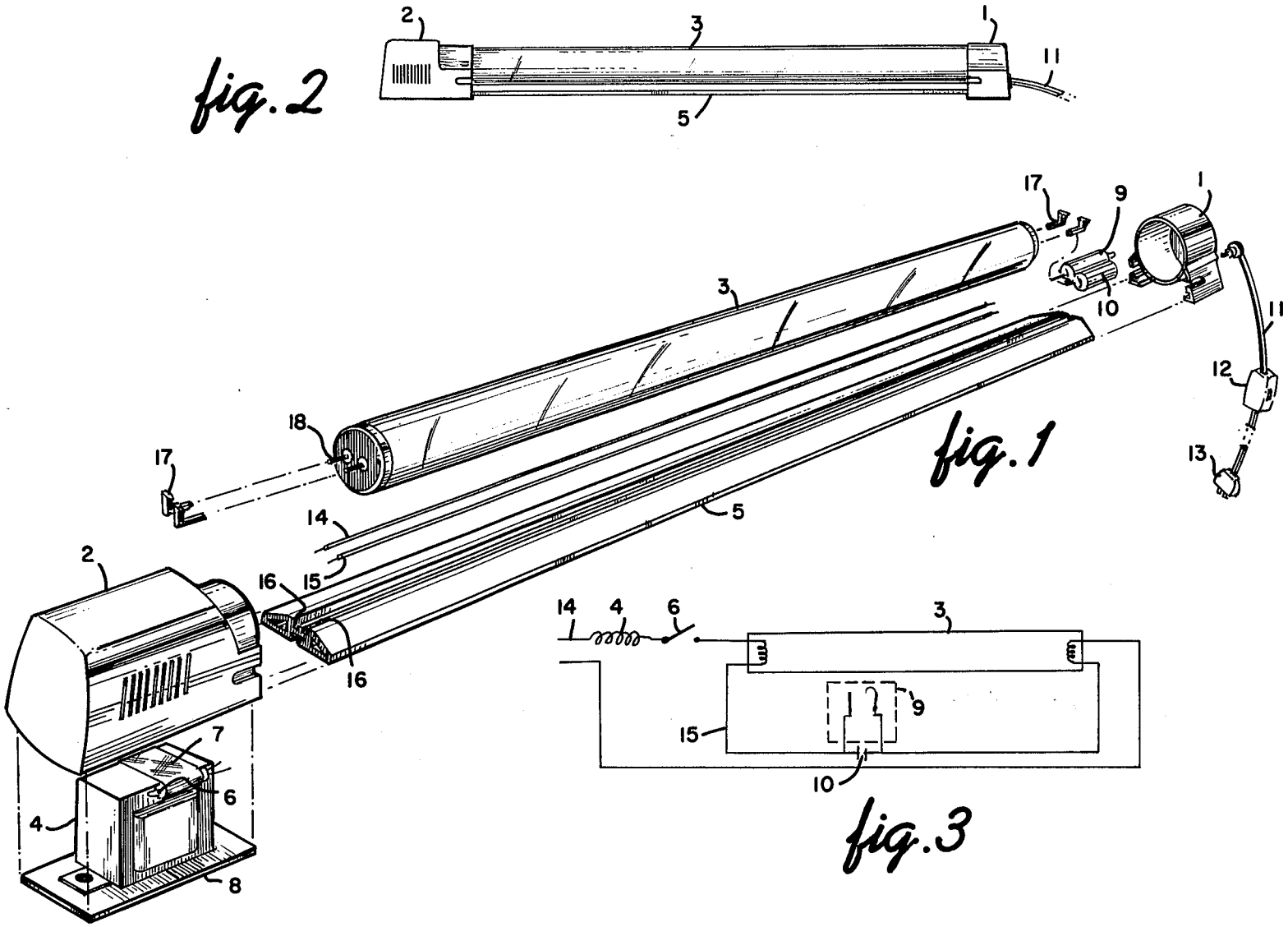
FIG. 1 is an exploded perspective view of a fluorescent lamp-ballast unit in accordance with this invention.
FIG. 2 shows the assembled unit.
FIG. 3 shows the electrical circuit thereof.

End cap 1 and housing 2 are permanently attached to fluorescent lamp 3 and are preferably made of suitable plastic. Housing 2 preferably has cooling slots in its walls to provide for dissipation of heat generated in choke ballast 4. An elongated support member 5, also preferably made of suitable plastic, is permanently attached to end cap 1 and housing 2. Lamp 3 fits into a shallow longitudinal channel in member 5 and, if desired, can be adhesively bonded thereto thereby improving the rigidity of member 5.

Disposed in housing 2 is a choke ballast 4 having a circuit breaker 6 fastened thereto, for example, by tape 7 to form a single assembly component. When circuit breaker 7 attains a predetermined temperature, say about 130° C., it opens the circuit. This provides protection if choke 4 overheats. Choke 4 is secured to a plate 8 which snaps in place into the bottom of housing 2. Disposed in end cap 1 is a small glow-switch starter 9 and a capacitor 10 in parallel therewith. For ease of assembly, starter 9 and capacitor 10 can be fastened together, for example, with tape, to comprise one structural unit or assembly component. An electrical cord 11 containing a cord switch 12 and having the usual plug 13 at its end extends from end cap 1.

Electrical connections between the components in end cap 1 and housing 2 are provided by insulated wire conductors 14 and 15 which press fit into tracks 16 in support member 5 for ease of assembling the unit. Also, for ease of assembly, slide-on connectors 17 are used to connect wires to pins 18 of lamp 3, which permits the standard bipin bases for preheat fluorescent lamps to be used.

In one example, lamp 3 was a 22 inch, 18 watt T12 lamp. The overall length of the unit including end cap 1 and housing 2 was 25 inches. In operation, the unit consumed 21 watts at 120 volts; choke 4 only dissipated 3 watts and lamp 3 produced 940 lumens, for a unit efficiency of 45 lumens per watt. In contrast, integral fluorescent lamp-ballast units utilizing resistors as ballasts have a unit efficiency of only about 21 lumens per watt.

We claim:

1. An integral fluorescent lamp-ballast unit comprising: a fluorescent lamp fastened to an end cap at one end and a housing at the other end; an elongated support member extending between the end cap and the housing, fastened to both, and serving as a backing for the lamp; and a ballast circuit disposed in the housing and/or the end cap, the ballast circuit including a choke, a preheat lamp starter and a circuit breaker, the circuit breaker being in close proximity to the choke ballast so as to be heated thereby, the circuit breaker being normally closed during normal lamp operation but becoming open and opening the circuit when the choke overheats.

2. The unit of claim 1 wherein the lamp is adhesively bonded to the support member, thereby improving the rigidity of the support member.

3. The unit of claim 1 wherein electrical connections between the ends of the unit are made by insulated wire conductors which are press fit into tracks in the support member for the purpose of ease of assembly of the unit.

4. The unit of claim 1 wherein the fluorescent lamp has bipin bases at its ends and electrical connections are made thereto with slide-on connectors.

5. The lamp of claim 1 including in the ballast circuit a circuit breaker fastened to the choke ballast to form a single assembly component which is mounted in the housing.

6. The lamp of claim 1 wherein the starter is a glow switch starter and wherein a capacitor is in parallel with the starter and wherein the starter and capacitor are fastened together to form another single assembly component which is mounted in the end cap.

* * * * *